US007459032B2

(12) United States Patent
Kondo et al.

(10) Patent No.: US 7,459,032 B2
(45) Date of Patent: Dec. 2, 2008

(54) PRESSURIZING FORMING PROCESS AND PRESSURIZED-AND-FORMED MEMBER

(75) Inventors: Mikio Kondo, Aichi (JP); Akira Sekiguchi, Kasugai (JP); Naoki Miyagawa, Kasugai (JP); Shigehide Takemoto, Kasugai (JP); Hiroshi Okajima, Aichi-ken (JP)

(73) Assignees: Kabushiki Kaisha Toyota Chuo Kenkyusho, Aichi-gun (JP); Toyota Jidosha Kabushiki Kaisha, Toyota-shi (JP); Tokyo Sintered Metals Corporation, Tokyo (JP)

( * ) Notice: Subject to any disclaimer, the term of this patent is extended or adjusted under 35 U.S.C. 154(b) by 289 days.

(21) Appl. No.: 10/166,647

(22) Filed: Jun. 12, 2002

(65) Prior Publication Data

US 2003/0003009 A1 Jan. 2, 2003

(30) Foreign Application Priority Data

Jun. 13, 2001 (JP) ..... 2001-178580

(51) Int. Cl.
*C23C 22/00* (2006.01)

(52) U.S. Cl. ..... 148/246

(58) Field of Classification Search ..... 419/28; 148/610, 246

See application file for complete search history.

(56) References Cited

U.S. PATENT DOCUMENTS

| | | | | |
|---|---|---|---|---|
| 2,849,107 | A * | 8/1958 | Logue, Jr. | 72/38 |
| 3,313,729 | A * | 4/1967 | Glasson | 508/158 |
| 3,819,521 | A * | 6/1974 | Sims | 508/160 |
| 3,999,952 | A * | 12/1976 | Kondo et al. | 75/244 |
| 4,138,348 | A * | 2/1979 | Grasshoff | 508/157 |
| 4,284,670 | A * | 8/1981 | Kole | 427/422 |
| 4,312,210 | A * | 1/1982 | Nishizawa et al. | 72/267 |
| 4,401,579 | A * | 8/1983 | Kratzer | 508/219 |
| 4,478,731 | A * | 10/1984 | Gaucher | 508/539 |
| 4,834,891 | A * | 5/1989 | Eguchi et al. | 508/158 |
| 4,900,459 | A * | 2/1990 | Ohmori et al. | 508/162 |
| 5,020,350 | A * | 6/1991 | Knepp et al. | 72/45 |
| 5,191,098 | A | 3/1993 | Koenig et al. | |
| 5,360,560 | A * | 11/1994 | Schmid et al. | 508/497 |
| 5,468,401 | A | 11/1995 | Lum et al. | |
| 5,589,095 | A * | 12/1996 | Yuan et al. | 508/168 |
| 5,767,426 | A | 6/1998 | Oliver et al. | |
| 5,776,867 | A | 7/1998 | Przybylski et al. | |
| 5,782,954 | A | 7/1998 | Luk | |
| 5,792,728 | A * | 8/1998 | Yuan et al. | 508/168 |
| 6,013,225 | A | 1/2000 | Cadle et al. | |
| 6,190,605 | B1 * | 2/2001 | Cadle et al. | 419/66 |
| 6,194,357 | B1 * | 2/2001 | Murata et al. | 508/113 |
| 6,224,816 | B1 * | 5/2001 | Hull et al. | 264/401 |
| 6,231,635 | B1 | 5/2001 | Suzuki et al. | |
| 6,253,588 | B1 * | 7/2001 | Rashid et al. | 72/57 |
| 6,261,514 | B1 | 7/2001 | Lindberg et al. | |
| 6,344,169 | B2 * | 2/2002 | Tsuchida et al. | 419/38 |
| 6,355,208 | B1 | 3/2002 | Unami et al. | |
| 6,361,623 | B1 * | 3/2002 | Ishikura et al. | 148/254 |
| 6,375,709 | B1 * | 4/2002 | Storstrom et al. | 75/252 |
| 6,395,687 | B1 | 5/2002 | Hanejko | |
| 6,419,770 | B1 * | 7/2002 | Miyashita et al. | 148/610 |
| 6,455,476 | B1 * | 9/2002 | Imai et al. | 508/156 |
| 2001/0038802 | A1 * | 11/2001 | Ozaki et al. | 419/36 |
| 2003/0103858 | A1 * | 6/2003 | Baran et al. | 419/30 |

FOREIGN PATENT DOCUMENTS

| | | |
|---|---|---|
| EP | 0698435 | 2/1996 |
| JP | 57-062813 | 4/1982 |
| JP | 58-30358 | 2/1983 |
| JP | 3-269092 | 11/1991 |
| JP | 4-190915 | 7/1992 |
| JP | 5-331501 | 12/1993 |
| JP | 5-345897 | 12/1993 |
| JP | 7-47756 | 5/1995 |
| JP | 7-112231 | 5/1995 |
| JP | 7-216379 | 6/1995 |
| JP | 9-227906 | 9/1997 |
| JP | 09-272901 | * 10/1997 |
| JP | 10-85995 | 4/1998 |
| JP | 11-2189 | 1/1999 |
| JP | 11-140505 | 5/1999 |

(Continued)

OTHER PUBLICATIONS

English translation of JP 03-269092.*

(Continued)

*Primary Examiner*—Roy King
*Assistant Examiner*—Tima M McGuthry-Banks
(74) *Attorney, Agent, or Firm*—Oblon, Spivak, McClelland, Maier & Neustadt, P.C.

(57) ABSTRACT

A pressurizing forming process includes the steps of applying a higher fatty acid-based lubricant on a surface of a metallic workpiece and/or a forming surface of a forming tool, and forming, wherein a lubricating film including metallic soap is formed on a pressurized-and-contacted interface, at which the surface of the metallic workpiece and the surface of the forming tool are pressed against and are brought into contact with each other, in forming the metallic workpiece by pressurizing with the forming tool. The metallic workpiece and/or the forming tool can be heated prior to or in the forming step.

12 Claims, 5 Drawing Sheets

FOREIGN PATENT DOCUMENTS

| | | | |
|---|---|---|---|
| JP | 2000-63880 | | 2/2000 |
| JP | 2000-199002 | | 7/2000 |
| JP | 2000-509440 | | 7/2000 |
| JP | 2000-290703 | | 10/2000 |
| JP | 2000-309793 | * | 11/2000 |
| JP | 2001-81495 | | 3/2001 |
| WO | WO97/12951 | | 4/1997 |
| WO | WO9712951 | * | 4/1997 |
| WO | WO 02/12420 A1 | | 2/2002 |

OTHER PUBLICATIONS

Machine translation of JP 05-345897.*
ASM Handbook, vol. 7, Powder Metallurgy, ASM International, 1984, pp. 415-417.*
Machine translation of JP 09-227906.*
Metals Handbook, Ninth Edition, vol. 14, Forming and Forging, ASM International, 1988, pp. 508-511.*
Machine translation of JP 2000-309793.*
Patent Abstracts of Japan, JP 2000-309793, Nov. 7, 2000.

* cited by examiner

PRESSURIZING FORMING PROCESS AND PRESSURIZED-AND-FORMED MEMBER

BACKGROUND OF THE INVENTION

1. Field of the Invention

The present invention relates to a process for forming a metallic workpiece by pressurizing, process which can attain favorable pressurizing-and-forming characteristics. Moreover, it relates to a pressurized-and-formed member which is produced by the pressurizing forming process.

2. Description of the Related Art

Plastic processing has been carried out in order to make metallic workpieces into desired shapes or have the resulting metallic articles show good characteristics in terms of the strength, and so forth, by pressurizing and forming. For example, it is possible to name the following: forging which is carried out while a metallic mass is placed on a die; re-compressing which is carried out in order to highly densify sintered members, in order to give a high accuracy thereto, or the like; coining; and sizing; and moreover rolling in which rollers are used, as well as extruding in which dies are used, drawing or forming by rolling, and so on.

In the meantime, when such pressurizing forming processes are carried out, a high pressure is exerted to the contact surface (or the pressurized-and-contacted interface) between a forming tool, such as dies, rollers, dies, and the like, and a metallic workpiece. Accordingly, in order to attain favorable pressurizing-and-forming characteristics by inhibiting the seizure, etc., between the forming tool and the metallic workpiece, it is necessary to securely give a lubricative characteristic, which can withstand the high pressure, and so forth, to the pressurized-and-contacted interface.

As for such a lubricating method, the following have been carried out conventionally. For instance, in an oil lubricating method, an oil is applied onto a surface of a metallic workpiece or a forming surface of a die, and so forth, by spraying, or the like. In a chemical conversion treatment (e.g., the Bonde treatment (trade name)), a phosphate film is formed on a surface of a metallic workpiece or a surface of a die, and the like. Moreover, when a metallic workpiece is small relatively, it has been often carried out so that a dried lubricant powder is applied on a surface of the metallic workpiece. The lubricant powder is made from zinc stearate (hereinafter abbreviated to as "ZnSt."), and so on. The applying operation is carried out in the following manner. The metallic workpiece and the lubricant powder are charged into a tumbling barrel, and the lubricant powder is applied on the metallic workpiece by the tumbling action.

However, when the oil lubricating method or the chemical conversion treatment is carried out, it has been required to spend much expenses to disposed of the waste fluids. In particular, since the environmental regulations have become strict recently, the processing methods are not a preferable lubricating method at all, processing methods which discharge waste fluids making large environmental loads.

Moreover, when the oil lubricating method is carried out, the working environment deteriorates due to the adhesiveness, and so forth, on the resultant formed articles, and accordingly it is necessary to additionally carry out a degreasing step. In addition, when the forming allowance (or the ironing allowance) is large, the oil lubricating method cannot attain a sufficient lubricative characteristic so that it results in the damages to dies, or the like, and in lowering the longevity thereof.

When the chemical conversion treatment is carried out, it is possible to attain a favorable lubricative characteristic. However, it is necessary to carry out a pre-treatment step, etc., and is required to spend high film processing costs for preparing a lubricating film. Moreover, when the chemical conversion treatment is carried out, it is needed to control the waste fluids much stricter than it is needed in the oil lubricating method. Accordingly, the chemical conversion treatment is not preferable in view of the man-hour requirements and the processing costs.

In addition, the method in which the lubricant powder is applied on a surface of a metallic workpiece is not practical at all, because the method is applicable limitedly to cases where metallic workpieces are small-sized articles, and because it is further necessary to additionally carry out a tumbling step, and so forth.

SUMMARY OF THE INVENTION

The present invention has been developed in view of such circumstances. Namely, it is therefore an object of the present invention to provide a pressurizing forming process which employs a lubricating method being capable of reducing the environmental loads, and which can attain favorable pressurizing-and-forming characteristics. Moreover, it is another object of the present invention to provide a pressurized-and-formed member which is good in terms of the superficial properties, the dimensional accuracy, and the like.

Hence, the inventors of the present invention studied wholeheartedly to solve the problems. As a result of trial and error over and over again, they found out that it is possible to attain favorable pressurizing-and-forming characteristics in the following manner. For example, a higher fatty acid-based lubricant is intervened at the pressurized-and-contacted interface between metallic workpieces and forming tools. Then, the metallic workpieces are formed by pressurizing in a warm state. Thus, they arrived at completing the present invention.

Pressurizing Forming Process

Namely, a pressurizing forming process according to the present invention comprises the steps of: applying a higher fatty acid-based lubricant on a surface of a metallic workpiece and/or a forming surface of a forming tool; heating the metallic workpiece and/or the forming tool; and forming the metallic workpiece by pressurizing with the forming tool in a warm state.

When warm pressurizing forming is carried out in such a state that the higher fatty acid-based lubricant intervenes between the metallic workpiece and the forming tool, a new lubricant film, which comprises metallic soap, is formed on the pressurized-and-contacted interface between the metallic workpiece and the forming tool. Accordingly, it is possible to attain favorable lubricating characteristics. In particular, when a forming allowance (or a deformation magnitude of the metallic workpiece) is large, namely, even when high-pressure forming is carried out, no bonding, scoring, or the like, arises between both of them. Consequently, it is possible to reduce a pull-out pressure (or an ejection pressure). Then, due to the good pressurizing-and-forming characteristics, it is possible to greatly prolong the longevity of the forming tool, such as dies, etc.

Moreover, since the higher fatty acid-based lubricant is used, there arises no problems which associate with disposing of the waste fluids in the chemical conversion treatment, and so forth. In addition, it is not necessary to carry out special pre-treatments, and the like. Accordingly, it is possible to lower the costs required for forming by pressurizing.

Note that the "metallic workpiece," set forth in the present specification, can be either raw materials like steel or raw materials made from sintered metals. Further, the form of the metallic workpiece cannot necessarily be specified, and accordingly can be ingots, plate-shaped materials, wire-shaped materials or tube-shaped materials. However, raw materials, and so on, such as metallic powders per se, which do not have a macro-outward form, are not involved in the "metallic workpiece," set forth in the present invention. In connection with the "metallic workpiece," the "forming," set forth in the present invention, implies to arrange workpieces, which have a macro-appreciable form, to a desired shape, namely, to process them to a desired shape. Therefore, the forming, in which raw material powders, such as metallic powders, etc., are formed by pressurizing to simply make a green compact, is not the "forming," set forth in the present invention.

Furthermore, the "forming tool" is not limited to dies, which are used in forging, and so forth, and accordingly can be rollers, dies, and the like. Moreover, the "pressurizing forming process (or a forming step)," set forth in the present specification, involves forging, rolling, extruding, drawing, forming by rolling, coining, sizing, re-compressing, and so on.

In addition, the applying step and the heating step cannot necessarily be carried out in the order as set forth above. Still further, the heating step and the forming step can be simultaneously carried out as a whole substantially. Namely, the heating step can be carried out while carrying out the forming step. This is because it is proper as far as the forming step is carried out in a warm state.

Besides, the inventors of the present invention kept on studying the pressurizing forming process wholeheartedly even after completing the above-described invention. As a result, they newly found out that it is possible to attain good pressurizing-and-forming characteristics even if the aforementioned heating step is not carried out. Thus, they arrived at completing the following invention.

Namely, it was understood anew that the present invention can make a pressurizing forming process, comprising the steps of: applying a higher fatty acid-based lubricant on a surface of a metallic workpiece and/or a forming surface of a forming tool; and forming, wherein a lubricating film comprising metallic soap is formed on a pressurized-and-contacted interface, at which the surface of the metallic workpiece and the surface of the forming tool are pressed against and are brought into contact with each other, in forming the metallic workpiece by pressurizing with the forming tool.

Thus, when the forming step is carried out, it is possible to obviate the step of heating the forming tool and/or the metallic workpiece, step which has been carried out prior to or simultaneously with the forming step. Consequently, it is possible to furthermore achieve the simplification of equipment, the reduction of production costs, the reduction of running costs, and so forth.

The reasons for the advantage are still under investigation. However, it is assumed as follows at present.

First, it will be hereinafter described on how the inventors of the present invention arrived at completing the present invention. When the inventors of the present invention carried out a sizing process (or a forming step) onto a sintered member (or an iron-based sintered workpiece), comprising an iron powder, without carrying out the heating step, it became apparent that no scoring, etc., occurred in a cylinder-shaped die (i.e., a forming tool), and that the ejection pressure was low as well. When the surface of the resulting pressurized-and-formed member was examined, it became apparent as well that the surface was covered with a metallic soap film. Note that the sizing processing is such that the outward shape of the metallic workpiece is ironed and compressed to a desired dimension.

From these phenomena, it was believed that, even when the heating step was obviated, the phenomena might have occurred, phenomena which were similar to those of the pressurizing forming process in a warm state. This is because it became evident that, according a variety of experiments which the inventors of the present invention carried out repeatedly, the metallic soap film was formed by mechanochemical reactions under a high pressure in a warm state.

Hence, the inventors of the present invention considered the phenomena, which occurred in the above-described sizing process, as follows. First of all, there is no question on that the outer surface of the sintered member is put into a highly pressurized state. Then, there arises the question on how the warm state is created. This is believed to result from the contribution of frictional heat. Namely, the sintered member is extruded while it slides on the inner wall of the die. In particular, at a diametrically-reduced portion (or a sizing portion) at which the sintered member is subjected to ironing by the die, the outer surface of the sintered member and the forming surface (or the inner wall surface) of the die are pressurized against and are brought into contact with each other heavily, and accordingly both of them move relatively in a considerably pressurized state. As a result, it is believed that heat is generated in a considerable quantity in the portions of the pressurized-and-contacted interface though it might be generated quite locally. Then, it is believed that, at the portions of the pressurized-and-contacted interface, the higher fatty acid-based lubricant is put into a warm state as well as into a highly pressurized state, and thereby the metallic soap film is newly formed on the workpiece by chemical absorption.

Moreover, even when the metallic soap film was formed locally, it actually exhibited sufficient effects in inhibiting the die from scoring as well as in reducing the driving force for pressing down the die and the pull-out pressure (or the ejection pressure) therefor. Therefore, as described above, it was confirmed that, even when the heating step is not carried out intentionally, the metallic soap film is formed in the aforementioned manner so that there arises cases where the heating step can be obviated prior to the forming step or it can be obviated in the course of the forming step.

Note that the case has been described so far in which the metallic workpiece is formed by pressurizing at room temperature without actively heating the forming tool. However, it is possible, of course, to gradually heat the forming tool. Although a large quantity of heat and large-sized equipment are required in order to heat the forming tool to 100° C. or more, it is possible to attain the reduction of energy consumption, the simplification of heating equipment and the reduction of cost as a whole when the forming tool is heated to less than 100° C. Indeed, when pressurizing forming equipment is operated, the overall temperature (or the entire temperature) of the forming tool is increased of itself so that, in the actual circumstances, it becomes less than 100° C., more specifically from about 50 to 60° C., without heating the forming tool on purpose. Thus, the inventors of the present invention confirmed that, when the temperature of the forming tool thus rises, the metallic soap film is formed stably so that the formability is furthermore improved. It is needless to say that such a natural temperature increment of the forming tool falls within the scope of the present invention as well.

When such a sizing step is carried out, it is preferable to apply the higher fatty acid-based lubricant, not to the forming tool, but to the sintered member in the applying step. This is arranged in order to let the metallic soap film form stably and continuously even when the sintered member moves in the forming tool. In order to furthermore stably form the metallic soap film, it is appropriate to carry out the applying step by a spraying method, and so forth, in which the higher fatty acid-based lubricant, being dispersed in water, is sprayed onto the sintered member, which is heated. This is because it is possible to readily and uniformly form the higher fatty acid-based lubricant film by the spraying method. Of course, as far as the higher fatty acid-based lubricant film can be formed uniformly, it is possible to carry out the applying step by a dipping method.

When the inventors of the present invention further studied wholeheartedly, it became apparent that a processing allowance could affect the formation of the metallic soap film in forming by pressurizing. Taking the case where the above-described sizing process is carried out as an example, when an ironing allowance (or a forming allowance, a processing allowance, etc.) falls within a certain range, the metallic soap film is formed so that the sizing process can be carried out favorably. However, when the ironing allowance is enlarged excessively beyond an ordinary sizing range without heating, or the like, the die, it was evident that a punch driving load or an ejection pressure enlarges considerably so that the formability might lower.

In view of such circumstances, it is appropriate that the ironing allowance can preferably be controlled in a range of from about 0.01 to about 0.1 mm or less, furthermore preferably from about 0.03 to about 0.07 mm in the sizing step. When the ironing allowance is about less than 0.01 mm, the pressurizing force is insufficient so that the metallic soap film cannot be formed stably. However, since such an ironing allowance falls in a range which hardly causes the problems associating with the scoring, ejection pressure, and the like, the formability is not poor at all. On the other hand, when the ironing allowance exceeds 0.1 mm, it is believed that no favorable metallic soap film is formed stably. This is because, when the ironing allowance enlarges, the pressure, which is exerted to the above-described pressurized-and-contacted interface, enlarges, and eventually the frictional force enlarge so that the frictional heat, which generates locally, enlarges sharply. Consequently, although the heat might generate locally, the temperature enters a high temperature region, which goes beyond the warm temperature region where a favorable metallic soap film is formed, in the pressurized-and-contacted interface. In such a high temperature region, it is believed that the metallic soap film might be thermally degraded or destroyed. Suppose that even if the temperature does not arrive at such a high temperature region, since the resultant metallic soap film is not formed in an inherently desirable warm state, it is believed that such a metallic soap film is relatively thin so that it cannot withstand the high pressure, which acts onto the pressurized-and-contacted interface, and is destroyed in the end. Whatever the reasons are, when the sizing step is carried out without carrying out the heating step, it is recommended to select and set up an appropriate ironing allowance in order to form a favorable metallic soap film and eventually to produce a favorable formability.

Pressurized-and-Formed Member

It is possible to grasp the present invention not only as the pressurizing forming process but also as a pressurized-and-formed member.

Namely, it is possible to grasp the present as pressurized-and-formed member, which is produced by way of the steps of: applying a higher fatty acid-based lubricant on a surface of a metallic workpiece and/or a forming surface of a forming tool; and forming, wherein a lubricating film comprising metallic soap is formed on a pressurized-and-contacted interface, at which the surface of the metallic workpiece and the surface of the forming tool are pressed against and are brought into contact with each other, in forming the metallic workpiece by pressurizing with the forming tool.

Of course, it is possible to carry out the heating step prior to the forming step or during the forming step. For instance, the present invention can make a pressurized-and-formed member, which is produced byway of the steps of: applying a higher fatty acid-based lubricant on a surface of a metallic workpiece and/or a forming surface of a forming tool; heating the metallic workpiece and/or the forming tool; and forming the metallic workpiece by pressurizing with the forming tool in a warm state.

The thus produced present pressurized-and-formed members are good in terms of the superficial properties, such as the surface roughness, the outward appearance, etc., because they are produced while the metallic soap film of good sliding characteristic is intervened between the metallic workpiece and the forming tool. Moreover, contrary to conventional pressurized-and-formed members which are produced by using lubricating oils, no lubricating oil is impregnated, or the like, into the present pressurized-and-formed members, and accordingly it is not required to carrying out degreasing, or the like. As a result, the present pressurized-and-formed members are good in terms of the handleability so that it is possible to simplify the subsequent production steps.

Contrary to those pressurized and formed by using the conventional Bonde treatment, the present pressurized-and-formed members are free from phosphorus (P), etc., which reside on the surface. Consequently, even when the present pressurized-and-formed members are subjected to surface hardening, for example, after the present pressurizing forming processes, they can offer a favorable surface heat-treatability.

Similarly to the above-described present pressurizing forming processes, an iron-based sintered workpiece can be an example of the metallic workpiece, and a sizing step can be an example of the forming step. Moreover, as an example of the pressurized-and-formed members which are subjected to a sizing step, it is possible to name tooth-shaped members. A specific example of the tooth-shaped members can be timing pulleys, and so forth, which engage with timing belts (or toothed belts), respectively.

Hence, in accordance with the present pressurizing forming processes, it is possible to efficiently produce pressurized-and-formed members while reducing the environmental loads. Moreover, the resulting pressurized-and-formed members are good in terms of the superficial properties, and so forth, and accordingly are not required to undergo the subsequent steps, such as the degreasing step, and the like.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
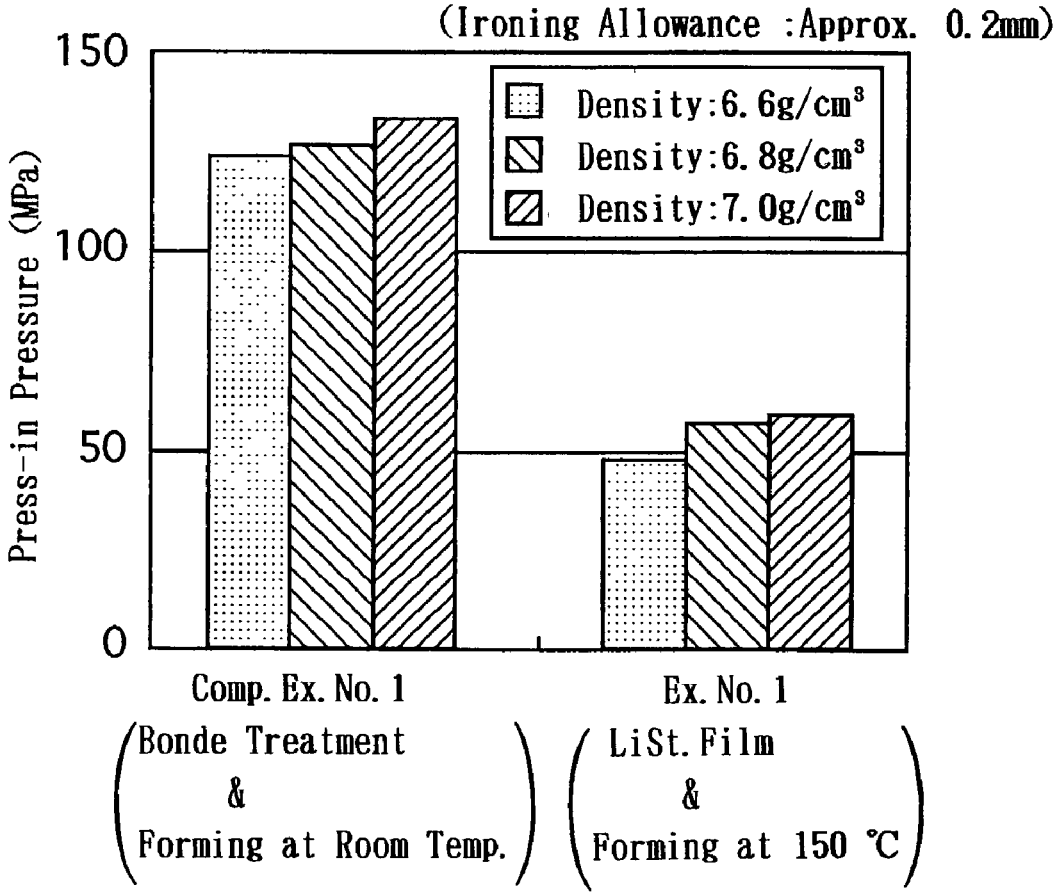
FIG. 1 is a graph for illustrating press-in pressures which were exhibited by Example No. 1 according to the present invention.

Having generally described the present invention, a further understanding can be obtained by reference to the specific preferred embodiments which are provided herein for the purpose of illustration only and not intended to limit the scope of the appended claims.

Hereinafter, the present invention will be described in detail with reference to specific embodiments. Note that the following descriptions are suitably applicable not only to the present pressurizing forming processes but also to the present pressurized-and-formed members.

Applying Step

The applying step is such that the higher fatty acid-based lubricant is applied on a surface of the metallic workpiece and/or a forming surface of the forming tool.

In addition to fatty acids, the higher fatty acid-based lubricant can appropriately be metallic salts of higher fatty acids. As for the metallic salts of fatty acids, it is possible to name lithium salts, calcium salts, zinc salts, or the like, of fatty acids. In particular, lithium stearate, calcium stearate and zinc stearate can be preferable options. Moreover, in addition to these, it is possible to use barium stearate, lithium palmitate, lithium oleate, calcium palmitate, calcium oleate, and so forth.

The higher fatty acid-based lubricant can preferably be lithium stearate, or the like, which is dispersed in water. When the higher fatty acid-based lubricant is dispersed in water, it is possible to more uniformly apply the higher fatty acid-based lubricant on a surface of the metallic workpiece and/or a surface of the forming tool by spraying, or the like.

In particular, when the higher fatty acid-based lubricant is sprayed onto the heated metallic workpiece and/or the forming tool, the water content evaporates so quickly that it is possible to uniformly apply the higher fatty acid-based lubricant on the metallic workpiece and/or the forming tool.

Moreover, in addition to spraying the higher fatty acid-based lubricant, which is dispersed in water, onto the metallic workpiece and/or the forming tool, the metallic workpiece and/or the forming tool can preferably be immersed directly into an aqueous solution of the higher fatty acid-based lubricant. In such a case as well, when the metallic workpiece and/or the forming tool is heated, the water content evaporates so quickly that it is possible to immediately complete applying the higher fatty acid-based lubricant uniformly onto the metallic workpiece and/or the forming tool.

To summarize, the applying step can preferably be such that it is carried out by a dipping method or a spraying method. In the dipping method, the heated metallic workpiece and/or the heated forming tool is dipped into an aqueous solution of the higher fatty acid-based lubricant. In the spraying method, the higher fatty acid-based lubricant, which is dispersed in water, is sprayed onto the heated metallic workpiece and/or the heated forming tool.

In particular, when the metallic workpiece is a sintered member, it is possible to efficiently carry out the applying step by utilizing the residual heat of the sintered member after the sintered step. Namely, it is preferred that the metallic workpiece can be a sintered member, which has undergone a sintering step in which a green compact made from a powder is sintered by heating, and that the applying step can be such a cooling step, which follows the sintering step, that the sintered member is subjected to the dipping method or the spraying method.

Note that, depending on the form, handleability, etc., of the forming tool, it is possible to directly immerse the forming tool into an aqueous solution of the higher fatty acid-based lubricant, thereby applying the higher fatty acid-based lubricant on the forming surface.

Heating Step

The heating step is such that the metallic workpiece and/or the forming tool is heated. Primarily, the heating step is for warming up the metallic workpiece and/or the forming tool prior to carrying out warm pressurizing forming in the forming step, which makes the subsequent step. Of course, it is more preferable to heat both of the metallic workpiece and the forming tool to a substantially equal temperature. In particular, when a predetermined dimensional accuracy is required, it is necessary to stringently control the temperature of the metallic workpiece and/or the forming tool while taking the thermal expansion coefficients of them into consideration. Secondary, it is possible to utilize the heating step for the heating in the above-described applying step. Namely, it is possible to think of dividing the heating step into a heating step for applying (or a first heating step) and a heating step for forming (or a second heating step). Moreover, it is possible to consider both of the first and second steps integral so that they can be regarded as a single step as a whole.

In the meantime, the heating temperature in such a heating step can preferably be controlled in a range of from about 100° C. or more to about less than a melting point of the higher fatty acid-based lubricant.

In view of the heating step for applying, when the heating temperature is controlled to about 100° C. or more, it is possible to quickly evaporate the water content of the higher fatty acid-based lubricant which is dispersed in water. On the other hand, when the heating temperature is controlled to about less than a melting point of the higher fatty acid-based lubricant, it is possible to inhibit the higher fatty acid-based lubricant, which is applied on the metallic workpiece and/or the forming tool, from running or flowing out.

In view of the heating step for forming, a new lubricating layer of good lubricating characteristic is generated during the subsequent pressurizing forming by controlling the heating temperature within the aforementioned range. The resulting lubricating layer is a new lubricating film comprising metallic soap that is different from the applied lubricant (such as lithium stearate). Note that the metallic soap is formed of the higher fatty acid-based lubricant which is adsorbed chemically onto a surface of the metallic workpiece and/or a forming surface of the forming tool. To put it differently, the higher fatty acid-based lubricant, such as lithium stearate (hereinafter abbreviated to as "LiSt."), etc., does not simply intervene at the pressurized-and-contacted interface between the metallic workpiece and the forming tool. The detailed mechanism has not necessarily been cleared yet at present, however, it is believed as follows. Metallic soap lubricants, such as LiSt., etc., cause chemical reactions between a surface of the metallic workpiece and a surface of the forming tool, thereby newly generating a firm metallic soap lubricating film of good lubricating characteristic on the surfaces. Note that, in addition to the temperature, the pressure, which acts onto the pressurized-and-contacted interface between the metallic workpiece and the forming tool, affects the generation of such a metallic soap lubricating film as well. However, the influence of the pressure will be described later.

The heating temperature can preferably be controlled in a range of from about 100 to about 200° C. When LiSt. is used as the higher fatty acid-based lubricant, the heating temperature can preferably be controlled in a range of from about 100 to about 220° C. Taking the productivity, the inhibition of the higher fatty acid-based lubricant from denaturing, and so forth, into consideration, the heating temperature can furthermore preferably be controlled in a range of from about 120 to about 180° C.

When the metallic workpiece is heated, it is possible to carry out such heating with a heating furnace, and the like. Moreover, it is possible to heat the forming tool with an electrothermal heater, such as a band heater, etc. Note that, when a predetermined dimensional accuracy is required, it is further preferable to provide the heating means with a temperature controller.

Forming Step

The forming step is such that the metallic workpiece is pressurized and formed with the forming tool in a warm state.

As described above, the so-called mechanochemical reactions take place between the metallic workpiece and/or the forming tool and the higher fatty acid-based lubricant. Due to the reactions, there is formed chemically a new lubricating film, which comprises metallic soap being adsorbed to a surface of the metallic workpiece and/or a forming surface of the forming tool. The metallic soap lubricating film effects better lubricating performance than the higher fatty acid-based lubricant itself does. In particular, when the metallic workpiece is an iron-based workpiece, a metallic soap lubricating film of good lubricating characteristic is formed. As a result, the frictional force is reduced sharply between an inner surface of the forming tool and an outer surface of the metallic workpiece. Accordingly, it is possible to utilize the present pressurizing forming processes to a variety of pressurizing forming operations. Even when a processing allowance (or a plastic deformation magnitude) is large, namely even when the workpiece is formed by a high pressure, it is possible to attain a favorable formability. In addition, the resultant pressurized-and-formed member can be ejected with a low ejection pressure, and so forth, and can be inhibited from scoring, and the like. Consequently, the superficial properties of the pressurized-and-formed member are remarkably favorable.

In the forming step, the term, "warm," implies that the forming step is carried out under properly heated conditions in which the metallic workpiece, the higher fatty acid-based lubricant, the forming pressure, and so on, are taken into consideration. Indeed, the forming temperature in the forming step can preferably be controlled to the same extent as the above-described heating temperature.

In the forming step, it is possible as well to properly determine the extent of "pressurizing" according to the types of pressurizing forming, the types of the metallic workpiece or the fatty acid-based lubricant, and the strength, material qualities, and so forth, of the forming tool.

However, in the case of the present pressurizing forming processes, it is possible to form the metallic workpiece with forming pressures which exceed the conventional forming pressures. For example, when carrying out sizing a sintered member, an ordinary ironing allowance falls in a range of from about 0.05 to about 0.1 mm. On other hand, in accordance with the present pressurizing forming processes, it is possible to set an ironing allowance to 0.2 mm or more. Moreover, when carrying out coining a sintered member, it is possible to set a coining pressure to 1,600 MPa or more. When re-compressing, sizing, or the like, a sintered member, the larger the forming pressure is the higher density, the better strength, and so on, are exhibited by the resulting pressurized-and-formed member. Indeed, in accordance with the present pressurizing forming processes, it is possible to sharply reduce the ejection pressure, the press-in pressure, etc. Accordingly, it is possible to lessen the force required for driving the forming tool.

Note that, when the higher fatty acid-based lubricant is used which is dispersed in water, and when it is applied onto the metallic workpiece which is heated to 100° C. or more, the higher fatty acid-based lubricant applies onto the metallic workpiece more uniformly and more firmly than a case where a powdered lubricant is applied to the metallic workpiece by tumbling. From this phenomenon, it is believed that a new film, which comprises metallic soap, is generated partially in this instance, and is absorbed chemically to a surface of the metallic workpiece.

When carrying out sizing a sintered member with a relatively small ironing allowance, it is possible to heat the metallic workpiece only in the step of applying the higher fatty acid-based lubricant, and furthermore it is possible to obviate heating the metallic workpiece and/or the forming tool in the forming step. Note that the possibility of obviating the heating step has been described in detail earlier.

Higher Fatty Acid-Based Lubricant

As described above, it is preferable to disperse the higher fatty acid-based lubricant in water in order that the higher fatty acid-based lubricant is coated uniformly on a surface of the metallic workpiece and/or a forming surface of the forming tool in the applying step.

In this instance, assuming that an aqueous solution, which is prepared by diluting a stock solution of the higher fatty acid-based lubricant by four times, is used, the stock solution can preferably be contained in a proportion of from about 0.1 to about 10% by mass, furthermore preferably from about 0.5 to about 5% by mass, with respect to the entire mass of the aqueous solution being taken as 100% by mass. Such an arrangement is preferable because it is possible to form a uniform lubricant film.

Moreover, in the preparation of the higher fatty acid-based lubricant aqueous solution, the higher fatty acid-based lubricant can be dispersed furthermore uniformly in water when a surfactant is added to the water in advance. As for the surfactant, it is possible to use alkyl phenyl-based surfactants, 6-grade polyoxyethylene nonyl phenyl ether (EO), 10-grade polyoxyethylene nonyl phenol ether (EO), anionic surfactants, cationic surfactants, ampholytic surfactants, nonionic surfactants, boric acid ester-based emulbon "T-80" (trade name), and so forth. Moreover, two or more of the surfactants can be combined to use.

For instance, when lithium stearate is used as the higher fatty acid-based lubricant, it is preferable to use three kinds of surfactants, 6-grade polyoxyethylene nonyl phenyl ether (EO), 10-grade polyoxyethylene nonyl phenyl ether (EO) and boric acid ester emulbon "T-80" (trade name), at the same time. When the surfactants are added to the higher fatty acid-based lubricant aqueous solution, the dispersibility of lithium stearate to water is furthermore activated, compared with the case where one and only surfactant is added to the aqueous solution.

In order to prepare the higher fatty acid-based lubricant aqueous solution which exhibits a viscosity applicable to the spraying method, the surfactant can preferably be contained in a proportion of from about 1.5 to about 15% by volume, furthermore preferably from about 1.5 to about 5% by volume, with respect to the entire mass of the stock solution being taken as 100% by volume. Note that the proportion is based on the assumption that the stock solution is diluted by four times to use.

In addition to the surfactant, it is preferable to further add an antifoaming agent in a small amount. This is because, when the higher fatty acid-based lubricant, which bubbles vigorously, is sprayed onto the inner surface, it is less likely to uniformly form a film of the higher fatty acid-based lubricant on an inner surface of the forming tool. Hence, it is desirable to add an antifoaming agent to the higher fatty acid-based lubricant aqueous solution. The antifoaming agent can be, for instance, silicone-based antifoaming agents. The addition proportion of the antifoaming agent can preferably fall in a range of from about 0.1 to about 1% by volume when the entire volume of the stock solution is taken as 100% by volume.

It is preferred that particles of the fatty acid-based lubricant, which is dispersed in water, can preferably have a maximum diameter of less than 30 μm. When the maximum particle diameter is 30 μm or more, the particles of the higher fatty acid-based lubricant are likely to precipitate so that it is difficult to uniformly apply the higher fatty acid-based lubricant on an inner surface of the forming tool.

It is possible to carry out coating the aqueous solution, in which the higher fatty acid-based lubricant is dispersed, by the above-described dipping method or spraying method. It is possible to carry out the spraying method by using spraying guns for coating operations, electrostatic guns, and so forth.

Note that the inventors of the present invention examined the relationship between the applying amounts of the higher fatty acid-based lubricant and the pressures required for ejection of the pressurized-and-formed products. According to the results, it has been understood that it is preferable to apply a lubricant film in such a thickness of from about 0.5 to about 1.5 μm on a surface of the metallic workpiece and/or a forming surface of the forming tool.

EXAMPLES

The present invention will be hereinafter described more in detail with reference to specific examples.

Example No. 1

In Example No. 1, three sintered members (or iron-based sintered workpieces), Sample Nos. 1 through 3, were prepared as the metallic workpiece. A sizing process, one of the pressurizing forming processes, was carried out onto them. Moreover, a used higher fatty acid-based lubricant was lithium stearate (or LiSt.). Hereinafter, the respective steps according to the present pressurizing forming process will be described in detail.

Manufacturing Sintered Members

The sintered members of Sample Nos. 1 through 3 were manufactured in the following manner. As a raw material powder, a segregation-inhibited powder "STARMIX" (trade name) was prepared. The segregation-inhibited powder had a particle diameter of 250 μm or less, comprised Fe, Cu, C and a lubricant, and was produced by Heganese Co., Ltd. Its composition was 2% by mass of Cu, 0.9% by mass of C, 0.8% by mass of the lubricant and the balance of Fe. The raw material powder was filled in a die for compacting (i.e., a filling step). The die was made from cemented carbide. Then, the raw material powder was compacted by pressurizing (i.e., a green-compact forming step), thereby manufacturing a cylindrical green compact which had a size of ϕ17 mm in diameter and 15 mm in length. Note that, however, three kinds of green compacts, whose densities were (a) 6.6 g/cm$^3$, (b) 6.8 g/cm$^3$ and (c) 7.0 g/cm$^3$, respectively, were produced by adjusting the compacting pressure in the compacting step.

Subsequently, these green compacts were heated at 1,150° C. for 30 minutes in a nitrogen atmosphere, and were thereby sintered (i.e., a sintering step). Thereafter, in the identical atmosphere, the green compacts were cooled by controlling the cooling rate at 100° C./min. Thus, the sintered members of Sample Nos. 1 through 3 were prepared which comprised the aforementioned green compacts, respectively. The diametric dimensions were (a) 17.038 mm for Sample No. 1, (b) 17.049 mm for Sample No. 2 and (c) 17.053 mm for Sample No. 3, respectively.

Preparing Higher Fatty Acid-Based Lubricant 25 g of an LiSt. powder was dispersed in 100 cc of water in which a surfactant was added in a proportion of 1.5% by volume. With respect to the dispersion, a pulverizing treatment was carried out for 100 hours by using a ball mill, thereby performing a micro-fining treatment. The ball mill was provided with steel balls which were coated with "Teflon" (trade name). Thereafter, the dispersion was diluted by 4 times, thereby making an aqueous solution whose final LiSt. concentration was 5% by mass. Note that LiSt., which was dispersed in water, had an average particle diameter of 3 μm. Moreover, the used surfactant was a mixture surfactant which comprised 6-grade polyoxyethylene nonyl phenyl ether (EO) in an amount of 0.5% by volume, 10-grade polyoxyethylene nonyl phenyl ether (EO) in an amount of 0.5% by volume and the balance of boric acid ester emulbon "T-80" (trade name).

Sizing Die

As for a forming tool, a sizing die (i.e., a forming die) was prepared which was made from cemented carbide. Its forming surface exhibited a superficial roughness of 0.4 z (as per Japanese Industrial Standard). The sintered members had a diameter of ϕ17.55 mm at the leading end. The sizing die had a diameter of ϕ16.85 mm at the sizing portion (i.e., the diametrically reduced portion). The leading end and the sizing portion had a curvature radius of 10 mm, respectively. When the differences between the diametric dimension of the above-described sintered members and the sizing portion of the sizing die were calculated, the differences fell in a range of from 0.203 to 0.188 mm, and were 0.22 mm approximately on average. The diametric difference (i.e., the diameter of a workpiece minuses the diameter of a sizing portion) is regarded as the ironing allowance set forth in the present invention.

The sizing die was heated by a band heater which was wound around the outer peripheral surface thereof. The band heater was controlled by a temperature controller so that the temperature of the sizing die was 150±5° C. (i.e., a heating step for forming).

Note that the band heater could arbitrarily set the heating temperature of the sizing die in a range of from RT (i.e., room temperature) to about 200° C. Moreover, the band heater could control the heating temperature within ±5° C. of the set temperatures in order to inhibit the accuracy of the product dimensions from lowering which was caused by the variation of the temperature in the sizing die.

Applying Higher Fatty Acid-Based Lubricant onto Sintered Members

Into the above-described aqueous solution of the higher fatty acid-based lubricant, the sintered members which were heated to 150° C. (i.e., a heating step for applying) were immersed (i.e., a dipping method), thereby coating a film comprising the LiSt. lubricant on the surface (i.e., an applying step). Note that, in Example No. 1, the higher fatty acid-based lubricant was applied onto the sintered members only. However, the aqueous solution of the higher fatty acid-based lubricant can be applied by spraying, or the like, onto the sizing die as well. Moreover, instead of the above-described dipping method, a spraying method can be used.

Sizing

The sintered members with coated LiSt. were heated again to 150° C. (i.e., a heating step for forming). Thereafter, the sintered members were subjected to sizing by using the aforementioned sizing die (i.e., a forming step).

Comparative Example No. 1

As for Comparative Example No. 1, sintered members, which were identical with those of aforementioned Sample Nos. 1 through 3, were subjected to the Bonde treatment, and were further subjected to sizing in the same manner as Example No. 1. Note that, however, the processing temperature was set at room temperature which was an ordinary processing condition at present.

Assessment

With respect to Example No. 1 and Comparative Example No. 1, the respective samples were examined for the press-in pressure at sizing, and the resultant press-in pressures are illustrated in FIG. 1 for the respective samples. Note that the press-in pressures were values which were obtained by dividing the maximum loads, which were exerted when the sintered members were pressed into the sizing die, with the cross sectional area of the sizing die at the sizing portion whose diameter was ϕ16.85 mm.

By the pressuring forming process according to Example No. 1, the press-in pressures were remarkably reduced by a factor of from about ⅓ to about ½ with respect to those of the samples which were produced by the pressuring forming process according to Comparative Example No. 1. Note the higher density the sintered members had the higher press-in pressure they required. It is believed that the phenomenon resulted from the facts that the ironing allowance enlarged slightly from 0.188 mm to 0.203 mm and the hardness heightened as well from Hv 140 to Hv 180.

Figure 2:
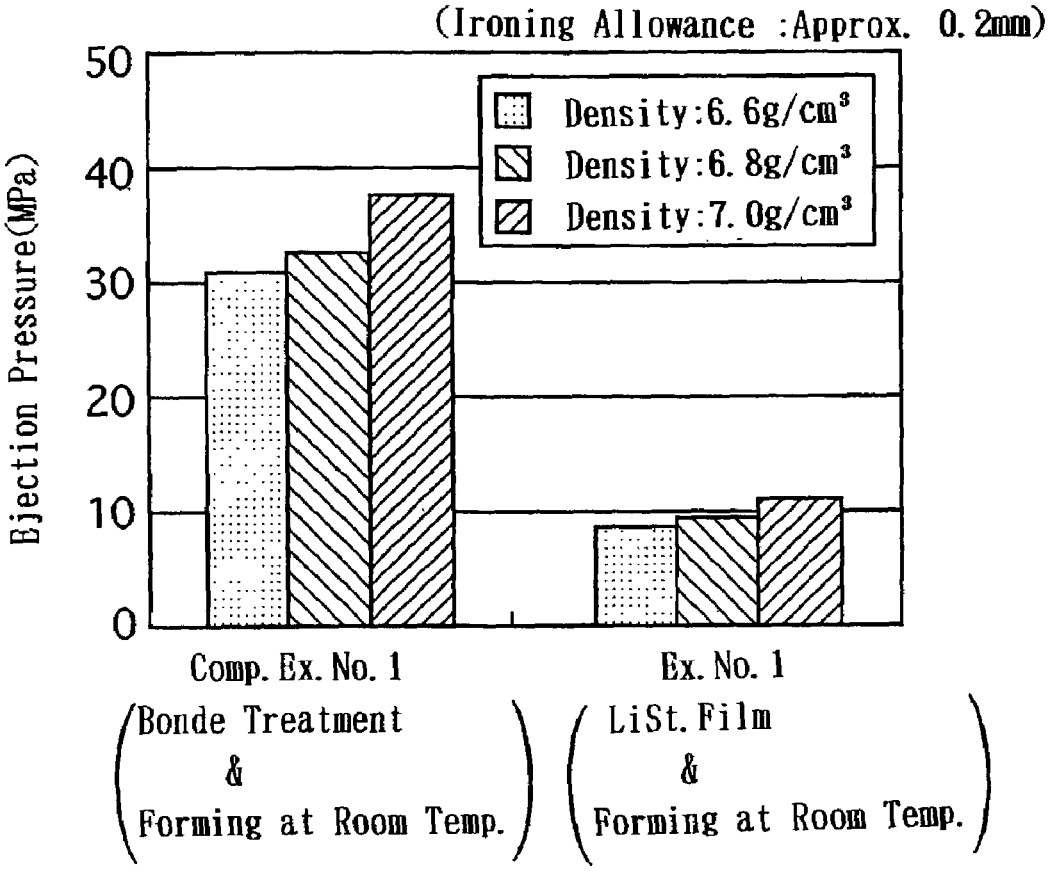
FIG. 2 is a graph for illustrating ejection pressures which were exhibited by Example No. 1 according to the present invention.

Subsequently, with regard to Example No. 1 and Comparative Example No. 1, the respective samples were examined for the ejection pressure which was exerted when the respective sintered members were ejected from the sizing die after sizing, and the resultant ejection pressures are illustrated in FIG. 2. Note that the ejection pressures were values which were obtained by dividing the maximum ejection loads with the side areas of the sintered members which contacted with the sizing die.

It is understood that the ejection pressures were remarkably reduced as well by a factor of about ⅓ by the pressurizing forming process according to Example No. 1 with respect to those of the samples produced by the pressurizing forming process according to Comparative Example No. 1.

Moreover, the respective sintered members, which were produced by the pressuring forming process according to Example No. 1, had extremely favorable superficial states. Specifically, they exhibited a superficial roughness of from about 0.5 z to about 1 z. On the other hand, although the sintered members according to Comparative Example No. 1 did not exhibit a poor superficial roughness, their surfaces were blackened.

Still further, following Example Nos. 2 through 4 were produced additionally.

Example No. 2

In Example No. 2, instead of above-described Sample Nos. 1 through 3 in which the ironing allowance was about 0.2 mm, a sintered member (i.e., Sample No. 4) was prepared in which the ironing allowance was about 0.05 mm. The production method and conditions of the sintered member were the same as those of Sample Nos. 1 through 3. Sample No. 4 had a size of ϕ16.9 mm in diameter 15 mm in length, and had and a density of 6.8 g/cm$^3$.

With respect to Sample No. 4, LiSt. was applied on the surface in the same manner as Example No. 1, warm sizing was carried out at 150° C. (i.e., Example No. 2). Moreover, Sample No. 4 was subjected to the Bonde treatment and sizing at room temperature (i.e., Comparative Example No. 2). With regard to the former and latter cases, the above-described ejection pressures were examined, respectively. The results are illustrated in FIG. 3.

Figure 3:
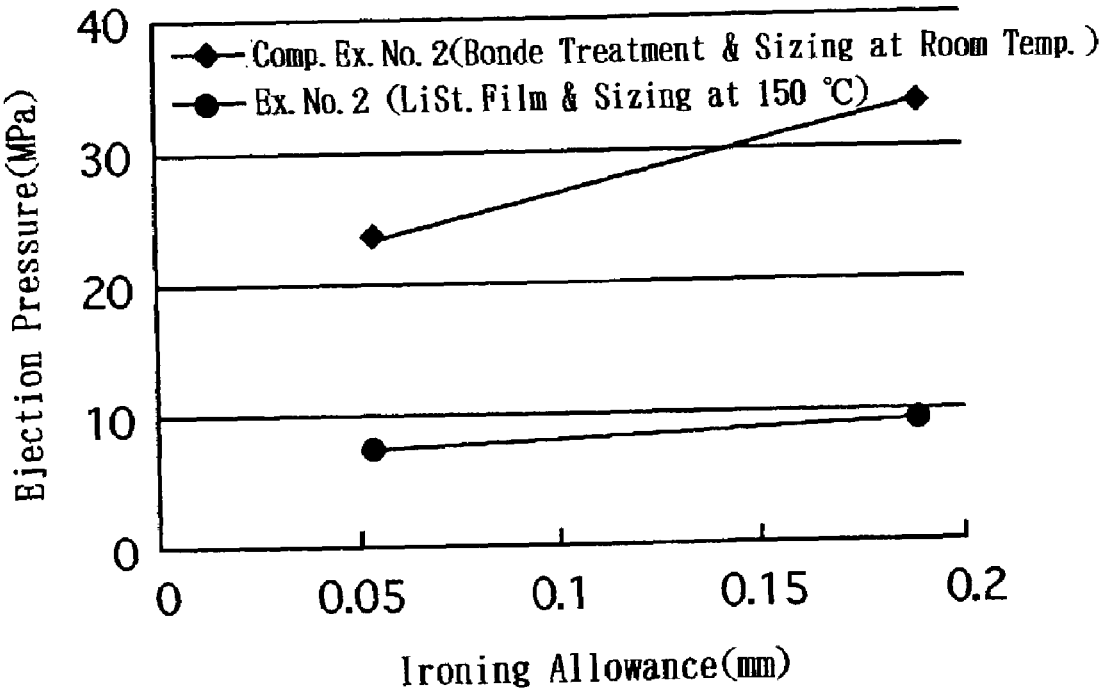
FIG. 3 is a graph for illustrating ejection pressures which were exhibited by Example No. 2 according to the present invention.

From FIG. 3, it is understood that, in the case of Example No. 2 according to the present invention, the ejection pressure was little affected by the magnitude of the ironing allowance so that it sustained the low value stably. On the other hand, in the case of Comparative Example No. 2, the ejection pressure was affected greatly by the ironing allowance so that it was as high as 4 times that of Example No. 4 when the ironing allowance was about 0.2 mm.

Example No. 3

Figure 4:
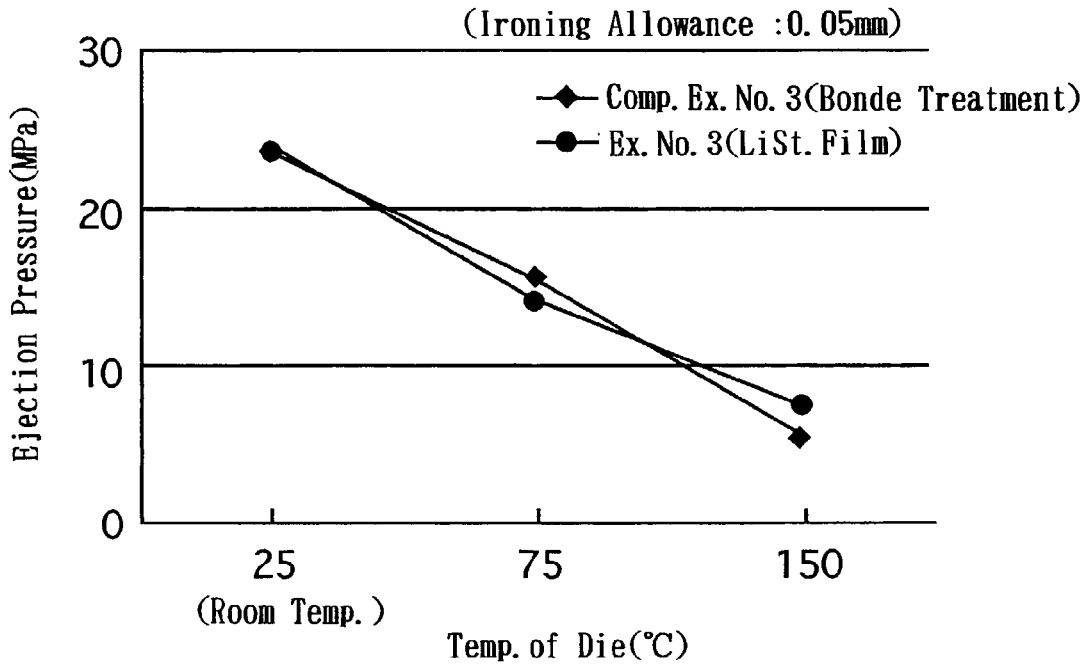
FIG. 4 is a graph for illustrating ejection pressures which were exhibited by Example No. 3 according to the present invention.

In Example No. 3 and Comparative Example No. 3, sizing according to Example No. 2 was carried out at the identical temperature. With regard to Example No. 3 and Comparative Example No. 3, the ejection pressures were examined, respectively. The results are illustrated in FIG. 4. In the case of Example No. 3 as well as in the case of Comparative Example No. 3, it is understood that the ejection pressures lowered as the temperature of the sizing die increased and simultaneously showed substantially similar tendencies.

The fact implies that the pressurizing forming process according to the present invention produces the formability equivalent to or more than the formability produced by the pressurizing forming process in which the conventional Bonde treatment is used. As described above, the pressurizing forming process, in which the Bonde treatment is used, suffers from the complicated production processes and the disposal of waste fluids. In view of these problems, it is possible to say that the pressurizing forming process according to the present invention can fully substitute therefor.

Figure 5:
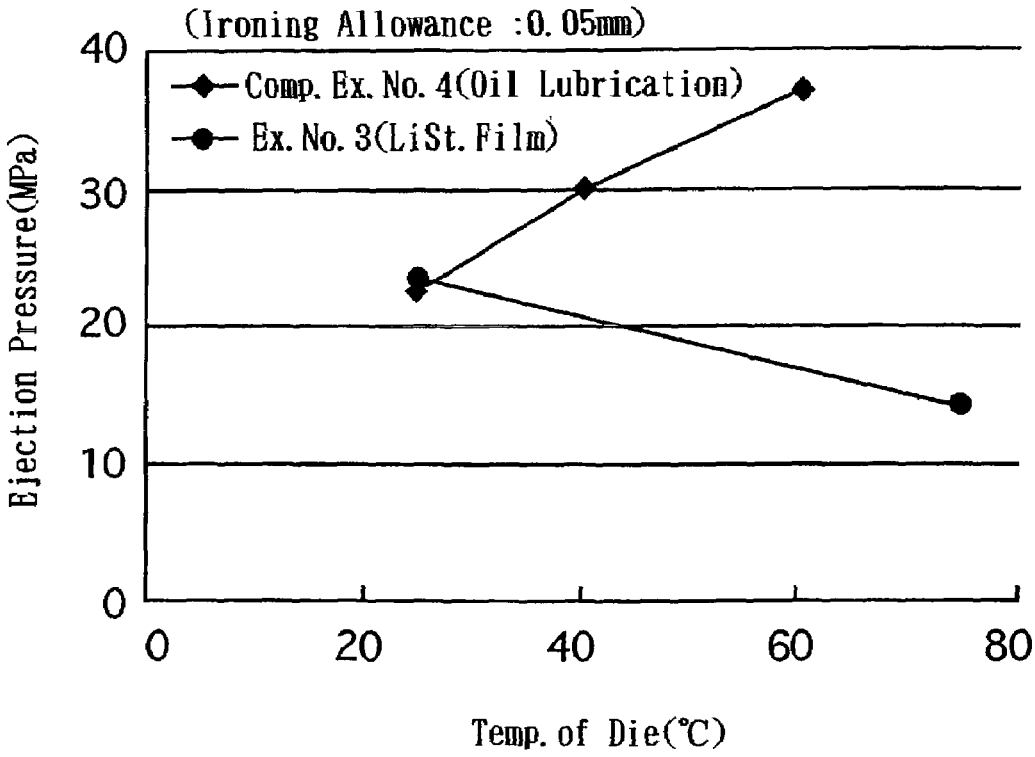
FIG. 5 is a graph for illustrating ejection pressures which were exhibited by Example No. 3 according to the present invention.

A lubricant oil immersion treatment substituted for the Bonde treatment designated as Comparative Example No. 3 in the section of Example No. 3. Likewise, the ejection pressures were examined. The results are illustrated in FIG. 5. Note that the lubricating oil used herein was "Unistar H-381R" (trade name) which was used for sizing and was produced by Nihon Yushi Co., Ltd. In this case as well, sizing was carried out while setting the temperature of the sizing die and the temperature of the samples identical with each other, and thereafter the ejection pressures were measured.

At the level of room temperature (about 25° C.), there was no great difference between the ejection pressures which were exhibited by Example No. 3 and Comparative Example No 4. However, in the case of Example No. 3, the ejection pressure was reduced as the temperature increased. On the contrary, in the case of Comparative Example No. 4, the ejection pressure was increased adversely as the temperature increased.

When the sizing step is continuously carried out actually, the temperature of the sizing die reaches 60° C. or more. Accordingly, it is understood that the production process, which employs the oil lubrication, is not a preferable option because the ejection pressure increases. Besides, when the pressurizing forming process is carried out while employing the oil lubrication, a lubricating oil is used in such a large amount that the working environment deteriorates considerably. Moreover, it is not a desirable option for furthermore improving the productivity because a degreasing step is required additionally after the forming step. On the other hand, when such a pressurizing forming step as the present examples is used, the more the temperature of the sizing die is increased by a continuous operation the lower the ejection pressure is decreased. In addition, the pressurizing forming process according to the present invention does not require a degreasing step, and so forth, after the forming step so that it is possible to furthermore enhance the productivity. Accordingly, the present pressurizing forming process is an exceptionally good option.

Finally, in FIG. 4 and FIG. 5, the ejection pressure is observed when the temperature of the sizing die is 25° C. (i.e., room temperature). As a result, it is understood that, even when the pressurizing forming process according to the present invention was used, the ejection pressure was produced which was equivalent to or more than the ejection pressure produced in the pressurizing forming process accompanying the conventionally employed Bonde treatment or oil lubricating treatment. The fact implies that, even when sizing is carried out in a cold state at around room temperature, the present pressurizing forming process can properly substitute for the conventional pressurizing forming process. As described above, it is believed that the advantages result from the fact that the metallic soap film is generated locally at the pressurized-and-contacted interface of the sizing portion of the sizing die by heating by means of the frictional heat, and so on.

Having now fully described the present invention, it will be apparent to one of ordinary skill in the art that many changes and modifications can be made thereto without departing from the spirit or scope of the present invention as set forth herein including the appended claims.

What is claimed is:

1. A pressurizing forming process comprising the steps of:

heating a wrought or sintered metallic workpiece and/or a forming surface of a forming tool to a temperature of 100° C. or more;

adhering a higher fatty acid-based lubricant on a surface of the wrought or sintered metallic workpiece and/or the forming surface of a forming tool by a dipping method in which said heated metallic workpiece is immersed into an aqueous solution consisting of water, an optional surfactant, an optinal antifoaming agent, and said higher fatty acid-based lubricant, or by a spraying method in which a dispersion consisting of water, an optional surfactant, an optional antifoaming agent, and said higher fatty acid-based lubricant dispersed in the water is sprayed onto said heated workpiece and/or said heated forming tool; and forming, wherein a lubricating film comprising a metallic soap, which is produced from the higher fatty acid-based lubricant by a chemical reaction and has a different composition than the higher fatty acid-based lubricant, is generated on a pressurized-and-contacted interface, at which the surface of the metallic workpiece and the forming surface of the forming tool are pressed against and are brought into contact with each other, in forming the metallic workpiece by pressurizing with the forming tool.

2. The pressurizing forming process according to claim 1, wherein said metallic workpiece is an iron-based sintered workpiece which is made by sintering a green compact comprising an iron-based powder in which iron is a major component; and said forming step is a sizing step in which an outer shape of the sintered workpiece is compressed to a desired dimension by ironing.

3. The pressurizing forming process according to claim 2, wherein said formed metallic workpiece is a tooth-shaped member.

4. A pressurizing forming process comprising the steps of:

heating a wrought or sintered metallic workpiece and/or a forming surface of a forming tool to a temperature of 100° C. or more;

adhering a higher fatty acid-based lubricant on a surface of the wrought or sintered metallic workpiece and/or the forming surface of a forming tool by a dipping method in which said heated metallic workpiece is immersed into an aqueous solution consisting of water, an optional surfactant, an optional antifoaming agent, and said higher fatty acid-based lubricant, or by a spraying method in which a dispersion consisting of water, an optional surfactant, an optional antifoaming agent, and said higher fatty acid-based lubricant dispersed in the water is sprayed onto said heated workpiece and/or said heated forming tool; and forming the metallic workpiece by pressurizing with the forming tool in a warm state, wherein during the forming a lubricating film comprising a metallic soap, which is produced from the higher fatty acid-based lubricant by a chemical reaction and has a different composition than the higher fatty acid-based lubricant, is generated on the metallic workpiece.

5. The pressurizing forming process according to claim 4, wherein said metallic workpiece is an iron-based sintered workpiece which is made by sintering a green compact comprising an iron-based powder in which iron is a major component; and said forming step is a sizing step in which an outer shape of the sintered workpiece is compressed to a desired dimension by ironing.

6. The pressurizing forming process according to claim 5, wherein said formed metallic workpiece is a tooth-shaped-member.

7. The pressurizing forming process according to claim 1, wherein the higher fatty acid-based lubricant is applied uniformly on the surface of the metallic workpiece and/or the forming surface of the forming tool.

8. The pressurizing forming process according to claim 1, wherein the higher fatty acid-based lubricant is applied as an aqueous dispersion of the lubricant.

9. The pressurizing forming process according to claim 8, wherein in the aqueous dispersion the lubricant has a diameter of less than 30 μm.

10. The pressurizing forming process according to claim 4, wherein the higher fatty acid-based lubricant is applied uniformly on the surface of the metallic workpiece and/or the forming surface of the forming tool.

11. The pressurizing forming process according to claim 4, wherein the higher fatty acid-based lubricant is applied as an aqueous dispersion of the lubricant.

12. The pressurizing forming process according to claim 11, wherein in the aqueous dispersion the lubricant has a diameter of less than 30 μm.

* * * * *